US011313080B2

(12) United States Patent
Valkonen

(10) Patent No.: US 11,313,080 B2
(45) Date of Patent: Apr. 26, 2022

(54) MONITORING SYSTEM AND METHOD FOR WET END OF A PAPER OR BOARD MACHINE

(71) Applicant: Procemex Oy, Jyväskylä (FI)

(72) Inventor: Mika Valkonen, Äänekoski (FI)

(73) Assignee: PROCEMEX OY, Jyväskylä (FI)

( * ) Notice: Subject to any disclaimer, the term of this patent is extended or adjusted under 35 U.S.C. 154(b) by 0 days.

(21) Appl. No.: 17/299,174

(22) PCT Filed: Feb. 3, 2020

(86) PCT No.: PCT/FI2020/050065
§ 371 (c)(1),
(2) Date: Jun. 2, 2021

(87) PCT Pub. No.: WO2020/161389
PCT Pub. Date: Aug. 13, 2020

(65) Prior Publication Data

US 2021/0355637 A1 Nov. 18, 2021

(30) Foreign Application Priority Data

Feb. 4, 2019 (FI) ..... U20194017

(51) Int. Cl.
*D21G 9/00* (2006.01)

(52) U.S. Cl.
CPC ..... *D21G 9/0027* (2013.01)

(58) Field of Classification Search
USPC ..... 162/198, 263
See application file for complete search history.

(56) References Cited

U.S. PATENT DOCUMENTS 5,472,571 A 12/1995 Niemi
2018/0142412 A1 5/2018 Heaven et al.

FOREIGN PATENT DOCUMENTS

WO 2008034954 A2 3/2008
WO 2012049370 A1 4/2012

OTHER PUBLICATIONS

International Preliminary Report on Patentability, Application No. PCT/FI2020/050065, dated Mar. 30, 2021, 17 pages.
PCT, International Search Report, Application No. PCT/FI2020/050065, dated May 7, 2020, 4 pages.
PCT, Written Opinion of the International Searching Authority, Application No. PCT/FI2020/050065, dated May 7, 2020, 7 pages.

*Primary Examiner* — Mark Halpern
(74) *Attorney, Agent, or Firm* — Ziegler IP Law Group, LLC

(57) ABSTRACT

A monitoring system for the wet end of a paper or board machine includes at least one light fixture for illuminating pulp supplied onto a wire, at least one image sensor to be placed above the head box at the wet end of the machine, for capturing the activity of the pulp supplied from the head box in the wire section, in the direction of the movement of the wire; and a computing device, to which at least one image sensor is configured to transmit image information for determining activity data on the pulp, the computing device being configured to adjust the settings of the paper or board machine, and/or of the monitoring system, on the basis of the determined activity data. A method for monitoring the wet end of a paper or board machine by means of a monitoring system includes adjusting the settings of the paper or board machine and/or of the monitoring system, on the basis of the determined activity data.

11 Claims, 4 Drawing Sheets

MONITORING SYSTEM AND METHOD FOR WET END OF A PAPER OR BOARD MACHINE

This application is a 371 of PCT/FI2020/050065 filed 3 Feb. 2020

FIELD

The aspects of the disclosed embodiments relate to a system for monitoring the wet end in paper or board machines, and a method for monitoring the wet end in paper or board machines.

BACKGROUND

Pulp, such as paper or board pulp, is formed at the wet end in paper and board machines. The activity of the pulp will influence the final quality of the paper and board product as well as the amount of energy used for dewatering the product. By monitoring the activity and by controlling the settings of the paper or board machine accordingly, it is possible to find such settings for the machine that the activity of the pulp will remain at a desired level and is of required type, whereby an end product of good quality is achieved. Cameras for monitoring the activity are normally fixed inside various beams or beam structures extending above the pulp, for monitoring the pulp from above, and/or by the sides of the wire section for monitoring the pulp from the side. However, the quality of images captured by a camera monitoring the pulp from above may be impaired by upward splashes from the pulp in paper and board machines, blurring the camera lenses. This makes it difficult to provide good quality images of the pulp and thereby to determine its activity accurately. Furthermore, it may not be possible to place cameras by the sides of the wire section of the paper machine because of lack of space, and web changes, for example. However, it is advantageous to monitor the activity of the pulp in order to meet strict quality specifications of the end products and to achieve an optimal drying energy level.

BRIEF SUMMARY

It is an aim of the present disclosure to provide and present a novel system for monitoring the wet end of a paper or board machine, as well as a method for monitoring the wet end. The monitoring system and method according to the disclosed embodiments are characterized in what will be presented in the independent claims, and the dependent claims relate to advantageous embodiments of the disclosed embodiments.

The disclosed embodiments relate to a system for monitoring the wet end of a paper or board machine. The system comprises at least one light fixture for illuminating pulp fed onto a wire, at least one image sensor to be placed above the head box at the wet end of the machine, for imaging the activity of the pulp fed from the head box in the wire section, in the direction of the movement of the wire; and a computing device to which the image sensor is configured to transmit the image information for determining pulp activity data, the computing device being configured to control the settings of the paper or board machine and/or the monitoring system on the basis of the determined activity data.

In an advantageous embodiment, the image sensor captures the activity of the pulp at an angle of not greater than 45° to the surface of the wire. In an advantageous embodiment, the activity is amplitude, scale, duration of activity, or a combination of these, in a predetermined area. In an advantageous embodiment, the computing device is an integrated part of the image sensor, or the computing device is connected to the image sensor in a wired or wireless manner, for receiving image information. In an advantageous embodiment, the determined activity data is used for controlling the settings of the head box and/or foils (blades) in the paper or board machine. In an advantageous embodiment, the determined activity data is used for controlling the settings of at least one image sensor in the monitoring system. In an advantageous embodiment, the determined activity data is used for controlling the settings of at least one light fixture in the monitoring system.

Furthermore, the disclosed embodiments relate to a method for monitoring the wet end of a paper or board machine. The method comprises illuminating at least one zone of the pulp supplied onto the wire by at least one light fixture; monitoring said at least one zone of the pulp supplied onto the wire by at least one camera placed above the head box, for determining activity data of the pulp in the zone; comparing the determined activity data with activity reference data to determine deviating activity data; and adjusting the settings of the paper or board machine and/or the monitoring system on the basis of the determined activity data.

In an advantageous embodiment, the method comprises adjusting the settings of the head box of the paper or board machine on the basis of the determined activity data. In an advantageous embodiment, the method comprises adjusting the settings of the foils of the paper or board machine on the basis of the determined activity data. In an advantageous embodiment, the method comprises adjusting the settings of at least one camera in the monitoring system on the basis of the determined activity data. In an advantageous embodiment, the method comprises adjusting the settings of at least one light fixture in the monitoring system on the basis of the determined activity data. In an advantageous embodiment, the method comprises illuminating and monitoring the pulp supplied onto the wire, in at least two zones on the wire, and determining the activity data of these at least two zones to be compared with reference activity data, and adjusting the settings of the paper or board machine and/or the monitoring system on the basis of the determined activity data.

DESCRIPTION OF THE DRAWINGS

In the following, the present disclosure will be described in more detail with reference to the appended drawings, in which.

DETAILED DESCRIPTION

Figure 1:
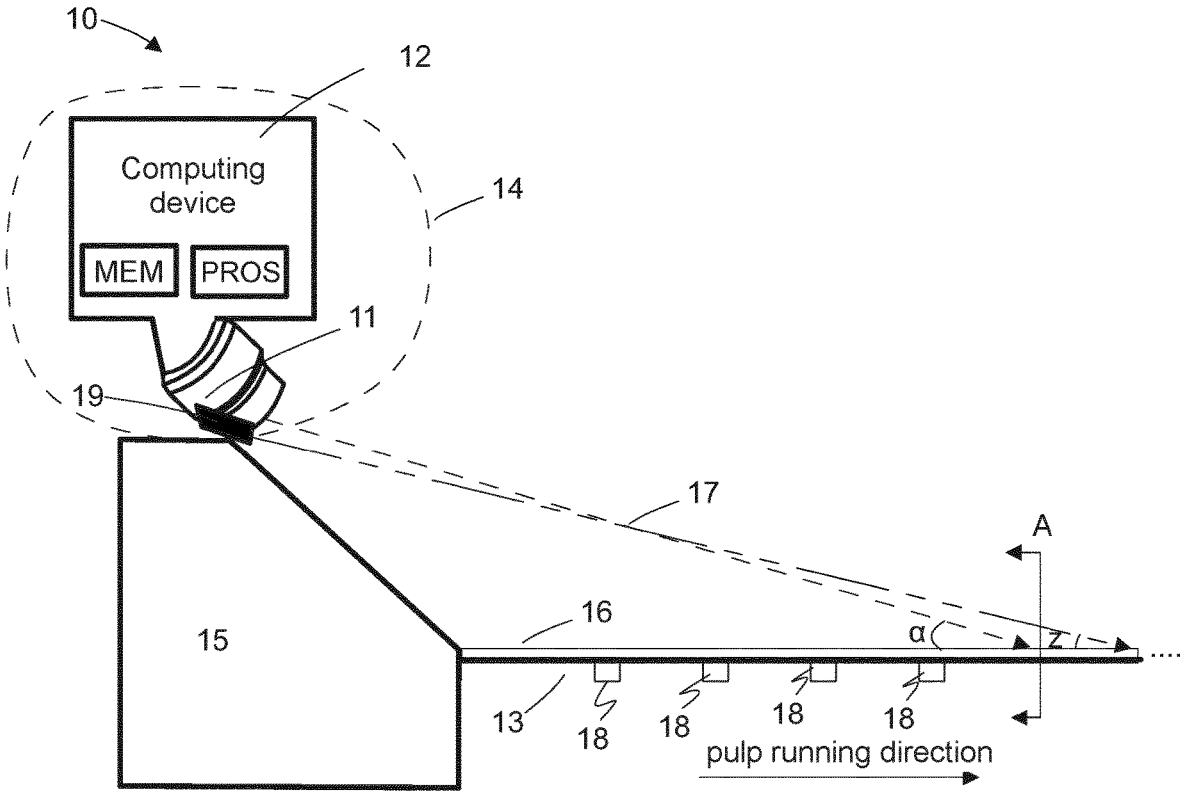
FIG. 1 shows a side view of a monitoring system according to an advantageous embodiment of the present disclosure, for determining the activity of the pulp at the wet end of a paper machine.

The web forming section of a paper machine comprises a head box and a wire section; a board machine may comprise several such web forming sections. The upstream section of the paper machine may be called the wet end of the paper machine. The wet end comprises not only grinding and mixing of the pulp and the web forming section but also a press section. The wet end is followed by the drying section and the dry end of the machine. After a reel-up, the finished board can be cut into rolls by a slitter.

From the head box of the web forming section, the pulp is sprayed in the form of an even jet onto a wire, over the full width of the wire. In this context, the term "pulp" also comprises the term "pulp suspension". By adjusting the settings of the head box and its feeding pipes, it is possible to influence the properties of the pulp. These are adjusted to make the pulp jet homogeneous with respect to its consistency and fine particle distribution. Further, by adjusting the flow rate, orientation and turbulence of the pulp jet, it is possible to influence the basis weight distribution and the fibre orientation. In the wire section, the pulp is dewatered to make the formed web sufficiently dry for further processing in the press section. More than 90% of the water contained in the pulp in the head box is removed on the lower and upper wires in the wire section. Cohesiveness of the web is provided by bonds between the fibres as well as surface tension forces.

By measuring the activity and analyzing the measurement results, e.g. by comparing with earlier measurement results or threshold values stored for different activity types/activities and the respective head box settings used, it is possible to adjust/control the settings of the head box and its feeding pipes as well as the foils under the wire. By adjusting the settings, e.g. by changing the mixing ratio, it is possible to achieve a more homogeneous consistency and fine particle distribution. Furthermore, by adjusting the flow rate, orientation and turbulence of the pulp jet from the head box, it is possible to influence the basis weight distribution of the pulp and the fibre orientation. By adjusting the settings, it is thus possible to find suitable settings for the head box and/or the foils to achieve a desired pulp activity, whereby a good quality product is more probably achieved. The activity measured from the pulp may be, for example, amplitude, scale of activity, duration of activity, or a combination of these in a predetermined zone. Adjustable properties of the foils may include, for example, the height and/or angle of the foils.

In addition to controlling/changing the settings of the head box and its feeding pipes as well as the foils under the wire by measuring the activity of the pulp and analyzing the measurement results, it is also possible to adjust the settings/position of one or more activity cameras and/or light fixtures in the monitoring system, whereby said one or more activity cameras and/or light fixtures may be placed by the side of the wire, above the head box, at the edge of the head box, and/or above the wire.

The settings of the cameras may be adjusted, for example, by changing the angle of the camera with respect to the wire and/or by electronically adjusting the pass band of the filter of the camera and/or, in the case of a colour camera, by changing its filter, e.g. blue, green, red, or a combination of these. The angle of the camera may also be adjusted in the cross direction so that a single camera can be used for imaging, i.e. scanning, the full width of the paper web, if necessary. Each position in the cross direction requires that the settings of the light fixture are adjusted to correspond to the field of view selected for the camera. In general, activity cameras capture images of the pulp at an angle smaller than 90°; for example, cameras placed above the head box and cameras placed at a low level by the side of the wire capture images at an angle of approximately/not greater than 45° to the wire. When the field of view is adjusted on the basis of pulp activity data, it is possible to achieve a more accurate activity measurement than before, for example, when the camera captures images of an activity target which is closer or farther away than before and whose activity has been found to be deviating, on the basis of activity measurements taken. For example, if an analysis of the measurement shows that the amplitude of the activity is very low, or that activity is only found in a zone very close to the activity camera, the activity cameras which first measured the activity of the pulp on the wire at an angle of substantially about 45° can be adjusted to decrease their field of view to be e.g. smaller than 30° or anything between 0 and 45°, depending on the measurement result and the location of the camera. With the new field of view, it is possible to make the measurement of the amplitude of the activity more precise than before, and/or to capture images of different zones with the same camera. Capturing images of different zones may be necessary, for example, when foils are arranged in several different locations under the wire, and the camera can be set to capture images of each of these in an alternating manner, following the change of activity in the pulp caused by the foils as the pulp proceeds on the wire, if the activity measurements have, for example, indicated that adjusting one foil on the basis of activity measurements did not produce desired changes in the activity of the pulp, and an adjustment of the next foils will be necessary, and the activity data measured after the preceding foil will be needed for adjusting them. Or, for example, if an analysis of the activity measurement shows that there is activity in a given zone, the activity cameras which first captured the activity of the pulp on the wire at an angle of substantially about 7° can be adjusted to increase their field of view to be e.g. 10° or anything between 8 and 45°, depending on the measurement result, whereby the activity can be focused better in the center of the imaging area, i.e. the image captured. Logically, it is possible to adjust fields of view to be greater or smaller on the basis of the measurement results, as needed. By switching to infrared mode, it is possible to obtain information on the activity different from the range of visible light, in the same way as by using different filters. The settings of the light fixtures can be adjusted on the basis of the activity data, for example by changing the angle of incidence (direction) of the central beam of the light fixture with respect to the wire, and/or by changing the position of the light fixture in the x, y and/or z direction, and/or by changing the intensity, wavelength and/or the beam width of the light. The angle of incidence of the central beam of the light fixture with respect to the wire can be adjusted in a range between, for example, 15 and 30°. By adjusting the illumination on the basis of the measured pulp activity data, it is possible that the illumination of the activity can be improved or changed to show the activity better, or by changing the settings of the illumination such activity can be detected that could not be detected at all or could be poorly detected without changing the settings of the illumination.

FIG. 1 shows a side view of a monitoring system 10, according to an advantageous embodiment, for determining pulp activity at the wet end of a paper machine. At least one camera 14 is installed above a head box 15, in this embodiment a so-called Smart camera which comprises an image sensor 11 and a computing device 12 for analyzing image data, i.e. image information, captured by the image sensor 11, and for analyzing the activity of pulp 16 supplied from the head box 15 onto a wire 13. The computing device 12 comprises at least one memory for storing a computer program and image data, a processor for running the computer program, one or more types of data transmission means for receiving and transmitting data. The computing device 12 is connected to the image sensor 11 in such a way that the image data can be transmitted from the image sensor 11 to the computing device 12. Furthermore, the camera 14 may comprise a display for displaying e.g. image data or measurement results, as well as other means, such as data input means, different types of software, etc.

At least one light fixture 19 is installed by the side of the head box 15 for illuminating the pulp 16 running on the wire 13, at a given angle z for imaging. The angle is formed between the central line of the beam of light produced by the light fixture 19 and the planar surface formed by the wire 13, and preferably, it is normally e.g. 15° to 40°, e.g. 15° to 30°, or e.g. 20°. The illumination angles of the light fixtures 19 placed above the same head box may be equal to or different from each other. Also, the light fixtures may illuminate different points or the same point on the pulp 16, but at different angles.

Consequently, said at least one camera 14 installed above the head box 15 is configured to image the pulp 16 running on the wire 13. The image sensor 11 captures the pulp 16 at an angle α. The image α is the angle formed between the central line 17 of the field of view of the image sensor 11 and the planar surface formed by the wire 13, and it is normally smaller than 45°, advantageously 30° to 40°, e.g. 35°. On this image data captured at the angle α, the computing device 12 takes the necessary measurements to determine the activity of the pulp 16. Foils 18 are arranged underneath the wire 13, and they can be controlled or their settings can be adjusted to cause desired turbulence (activity) in the pulp 16. The activity data can be compared by the computing device 12 with predetermined activity data entered in the computing device, such as previous measurement data or threshold values set for activity, and the respective head box settings used. These comparisons can be used to determine the required adjustments for the supply of pulp 16 from the head box 15 or for the foils, for changing the activity of the pulp 16. The running direction of the pulp 16 is away from the head box 15, as shown by the arrow in FIG. 1. Cameras capturing the pulp activity may be called activity cameras. Predetermined activity data and threshold values set for activities, to which the measurement activity data are compared, and the respective head box adjustments used, may be called activity data references or activity reference data.

Also, the direction, angle, brightness, and/or other settings of the cameras 14 and the light fixtures 19 can be adjusted/changed on the basis of the activity data determined by the computing device 12.

Figure 2:
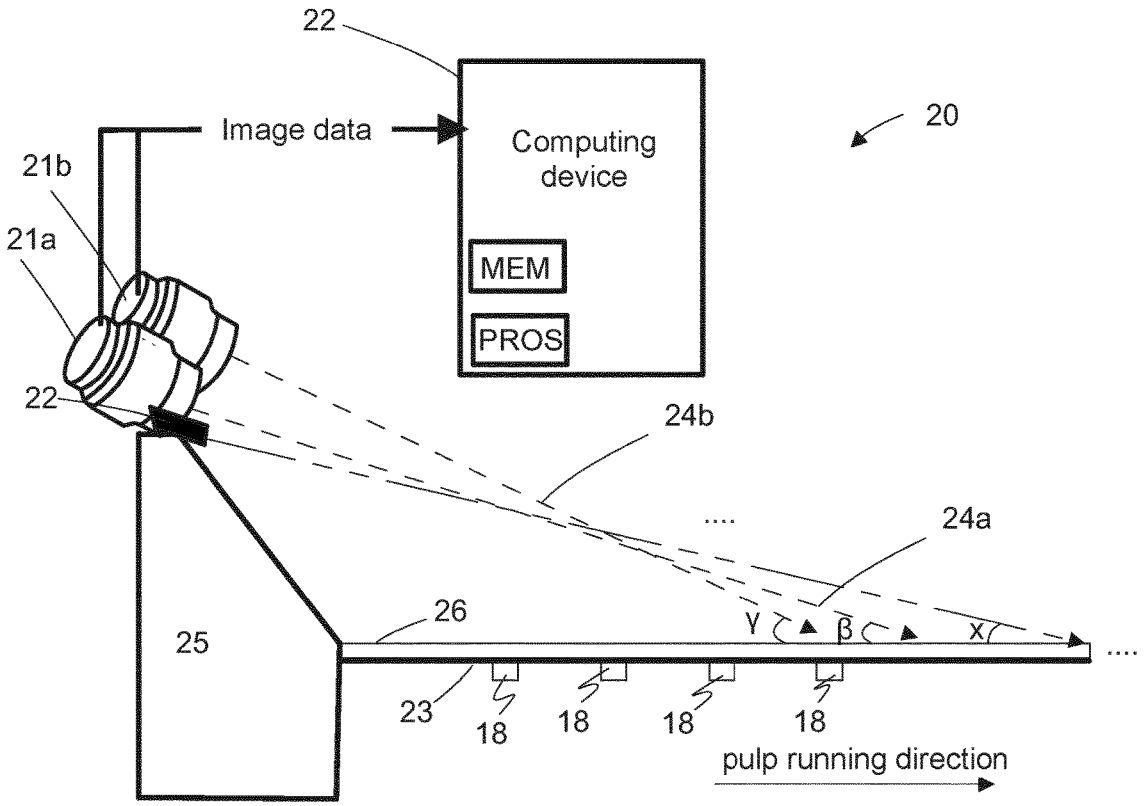
FIG. 2 shows a side view of a monitoring system according to an advantageous embodiment of the disclosed embodiments, for determining the activity of the pulp at the wet end of a paper machine.

FIG. 2 shows a side view of a monitoring system 20 according to an advantageous embodiment of the disclosed embodiments, for determining the activity of pulp at the wet end of a paper machine. At least two cameras 21*a*, 21*b*, each comprising an image sensor, are installed above the head box 25. Although two cameras are provided in this embodiment, the number of cameras might also be only one, or three or more, depending on e.g. the width of the wire 23 and the pulp 26 on it. In this context, the width refers to the direction perpendicular to the running direction of the wire and the pulp. The cameras 21*a*, 21*b* are connected to a computing device 22, either in a wired or a wireless manner. The computing device 22 is configured to process image data, i.e. image information, transmitted by the cameras 21*a*, 21*b* to the computing device 22, for measuring the activity of the pulp 26 supplied by the head box 25 onto the wire 23. The computing device 22 comprises at least one memory for storing a computer program and image data, a processor for running the computer program, one or more types of data transmission means for receiving and transmitting data. The computing device 22 is connected to cameras 21*a*, 21*b* in such a way that the image data can be transmitted from the cameras 21*a*, 21*b* to the computing device 22 in a wired or wireless manner. Furthermore, the computing device 22 may comprise a display for displaying image data or measurement results, as well as other means, such as data input means, different types of software, etc. The computing device 22 communicates with the cameras 21*a*, 21*b* over a data transmission network, for example by WLAN (Wireless Local Area Network), Bluetooth, or GSM, CDMA or WCDMA technologies or future technologies, or other data network technologies.

Further, at least one light fixture 22 is installed at the edge of the head box 25 to illuminate the pulp 26 running on the wire 23, for imaging. The light fixtures 22 illuminate the pulp 26 at an angle x. The angle x is an angle formed between the central light beam of the light fixture 22 and the planar surface formed by the wire 23. As mentioned above, these angles of illumination are normally smaller than 45°, advantageously 15° to 30°, e.g. 20°. The illumination angles of the light fixtures 22 placed above the same head box may be equal to or different from each other. The light fixtures may illuminate different points or the same point on the pulp 26, but at different angles.

The cameras 21*a*, 21*b* installed above the head box 25 are thus configured to capture the pulp 26 running on the wire 23, for determining the activity of the pulp 26. The image sensors 21*a*, 21*b* capture the pulp 26 at angles β and γ. The angle β is the angle formed between the central line 24*a* of the field of view of the image sensor of the camera 21*a* and the planar surface formed by the wire 23, and the angle γ is the angle formed between the central line 24*b* of the field of view of the image sensor of the camera 21*b* and the planar surface formed by the wire 23. Similarly, these angles are normally smaller than 45°, advantageously 30° to 40°, e.g. 35°. The view angles of the cameras placed on top of the same head box may be equal to or different from each other. The cameras 21*a*, 21*b* may capture different points, or the same point of the pulp 26 but at different angles. On the image data, the computing device 22 takes the required measurements to determine the activity of the pulp 26. Foils 28 are placed underneath the wire 23 for adjusting the activity of the pulp 26. The activity data can be compared by the computing device 22 with predetermined activity data on the computing device and with stored threshold values and the respective adjustments used; on the basis of these comparisons, it is possible to determine the required adjustments in the supply of pulp 26 from the head box 25 and/or in the foils 28, for changing/adjusting the activity. The running direction of the pulp 26 is away from the head box 25, as shown by the arrow in FIG. 2.

It is also possible to adjust/change the direction, angle, wavelength, and/or other settings of the cameras 21*a*, 21*b* and the light fixtures 22 on the basis of the activity data determined by the computing device 22, in addition to adjusting the supply of pulp 26 from the head box 25 and/or the foils 28. However, the direction, angle and/or other settings of the cameras 21*a*, 21*b* and the light fixtures 22 are adjusted/changed on the basis of the activity data to improve the quality of activity measurements, not in order to adjust the activity, although it is true that activity measurements of higher quality may influence the activity adjustment as well.

Figure 3:
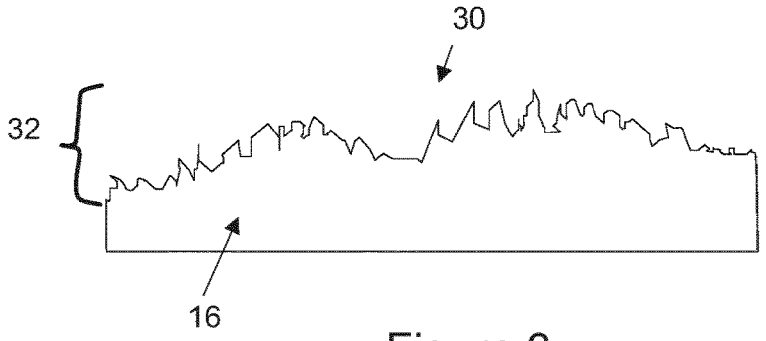
FIG. 3 shows a reduced view of a cross section of pulp shown in FIG. 1, in the direction A of FIG. 1.

FIG. 3 shows a reduced cross-sectional view of pulp 16 of FIG. 1 in the direction A, i.e. towards the head box 15, and transversely to the running direction of the pulp 16. As shown in FIG. 3, the activity 32 of the pulp 16 varies in different sectors over the width of the pulp 16. In this context, activity 32 refers to deviations from the basic level of the pulp 16.

Figure 4:
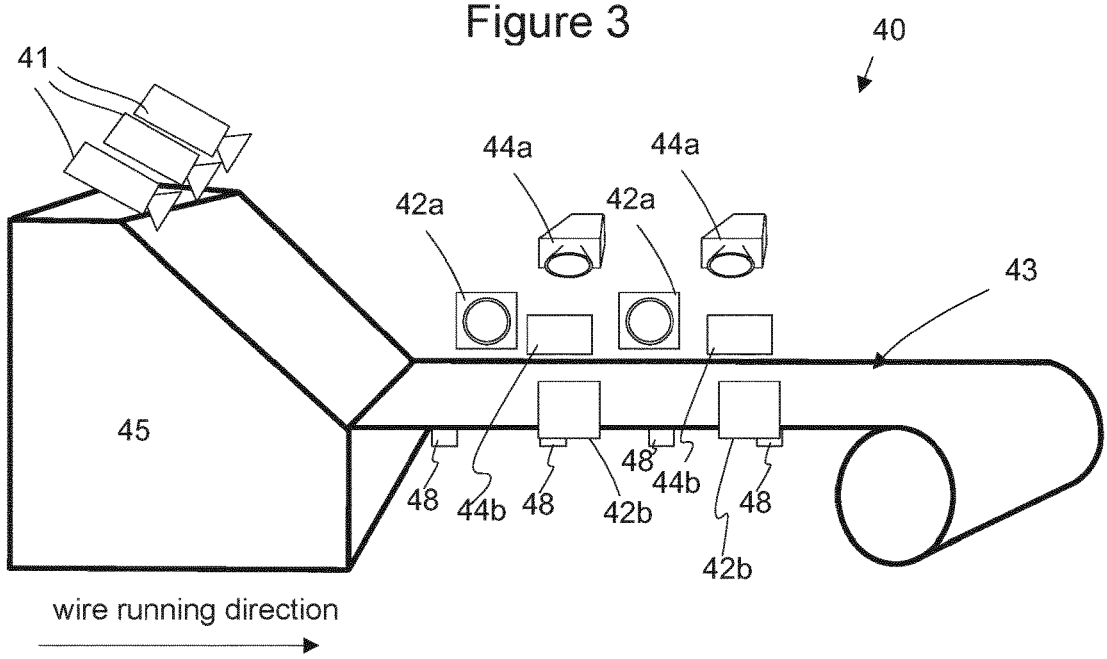
FIG. 4 shows a monitoring system according to an advantageous embodiment of the present disclosure, for determining the activity of pulp at the wet end of a paper machine.

FIG. 4 shows a monitoring system 40 according to an advantageous embodiment, for determining the activity of pulp 46 at the wet end of a paper machine. Light fixtures used in the monitoring system are not shown. In addition to activity cameras 41 installed above the head box 45, this monitoring system 40 comprises cameras for capturing the activity of the pulp on both sides of the wire 43 as well. In this embodiment, both low-level activity cameras 42*a* (on the left hand side of the wire 43, seen from the head box 45), 42*b* (on the right hand side of the wire, seen from the head box 45), and high-level activity cameras 44*a*) on the left hand side of the wire 43, seen from the head box 45), 445 (on the right hand side of the wire 43, seen from the head box 45) are provided on the sides. The low-level activity cameras 42*a*, 42*b* capture the activity of the pulp (not shown) supplied onto the wire 42 substantially at the level of the wire 43, i.e. on the horizontal level or e.g. at an angle smaller than 15°. The high-level activity cameras 44*a*, 44*b* capture the activity of the pulp on the wire 43 at a higher level than the low-level activity cameras 42*a*, 42*b*, for example at an angle smaller than 90° but greater than 15°, for example 45°. In this embodiment, too, the angles are determined in the same way as shown in FIGS. 1 and 2; that is, the angle is formed between the central line of the field of view of the image sensors of the activity cameras and the planar surface formed by the wire 43.

Figure 5:
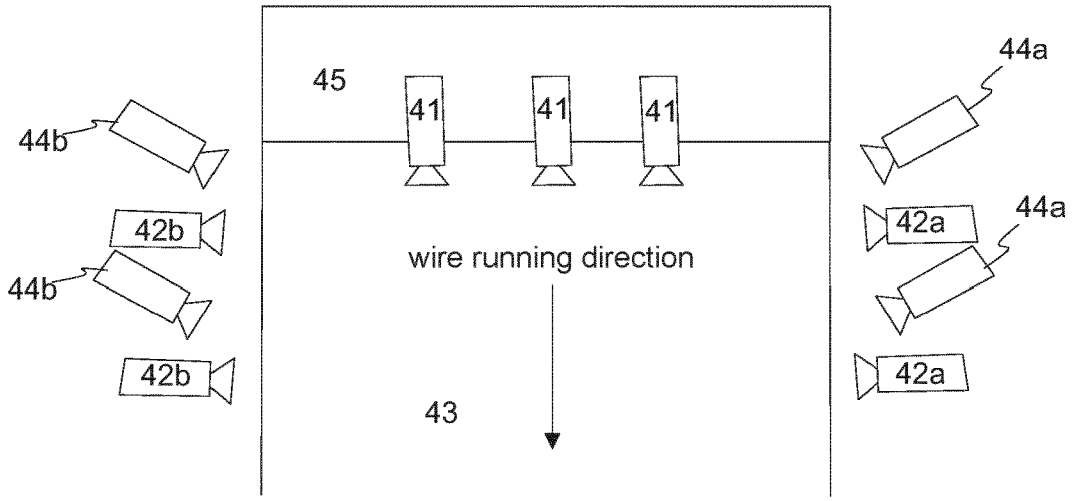
FIG. 5 shows a top view of the monitoring system of FIG. 4.

The number of cameras is not limited to the numbers shown in the figure, but it could also be only one, or three or more, depending on e.g. the width of the wire 43 and the pulp on it. The cameras 41, 42*a*, 41*b*, 44*a*, 44*b* are connected, in either a wired or wireless manner, to a computing device (not shown), as in FIG. 2, or they are so-called Smart cameras, as in FIG. 1. Foils 48 are provided under the wire 43 for adjusting the activity of the pulp. Further, on the basis of comparisons made by the computing device, it is possible to determine the required adjustments in the supply of pulp from the head box 45 and/or in the foils 48, for changing/adjusting the activity. The direction of running of the wire 43 is away from the head box 45, as shown by the arrow in FIG. 4. The running direction of the wire is always the same as the running direction of the pulp. FIG. 5 shows the monitoring system 40 of FIG. 4 in a top view.

Figure 6:
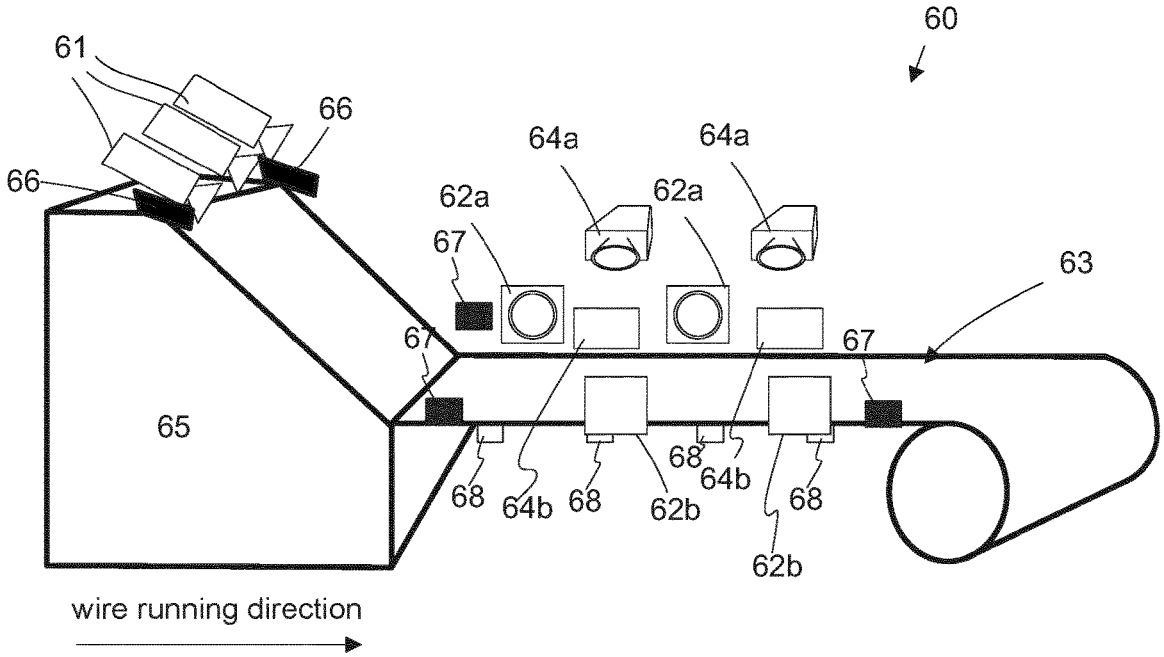
FIG. 6 shows a monitoring system according to an advantageous embodiment of the disclosed embodiments, for determining the activity of pulp at the wet end of a paper machine.

FIG. 6 shows a monitoring system 60 according to an advantageous embodiment, for determining the activity of pulp 66 at the wet end of a paper machine. In addition to activity cameras 61 and light fixtures 66 installed on the head box 65, this monitoring system 60 comprises cameras for capturing the activity of the pulp and light fixtures 67 on both sides of the wire 63, but it is possible to provide cameras and/or light fixtures on only one side of the wire 63. In this embodiment, both low-level activity cameras 62*a* (on the left hand side of the wire 63, seen from the head box 65), 62*b* (on the right hand side of the wire 63, seen from the head box 65), and high-level activity cameras 64*a* (on the left hand side of the wire 63, seen from the head box 65), 64*b* (on the right hand side of the wire 63, seen from the head box 65) are provided on the sides of the wire 63. The low-level activity cameras 62*a*, 62*b* capture the activity of the pulp (not shown) supplied onto the wire 62 substantially at the level of the wire 63, i.e. on the horizontal level or e.g. at an angle smaller than 15°. High-level activity cameras 64*a*, 64*b* capture the activity of pulp on the wire 63 from a higher level than the low-level activity cameras 62*a*, 62*b*, for example at an angle smaller than 90° but greater than 15°, for example 45°. In this embodiment, too, the angles of illumination are smaller than 45°, that is about 15° to 30°. The angles of view and the angles of illumination are determined in this embodiment in the same way as shown in FIGS. 1 and 2; that is, the angle is formed between the central line of the field of view of the image sensors of the activity cameras and the planar surface formed by the wire 63, and the angles of illumination between the central beam of the light fixture 66, 67 and the planar surface formed by the wire 63.

Figure 7:
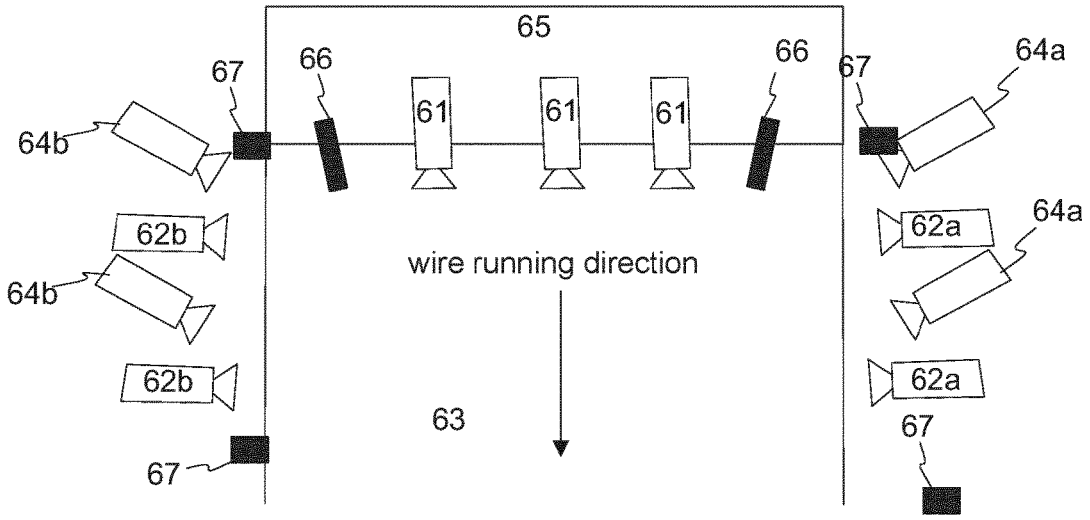
FIG. 7 shows a top view of the monitoring system of FIG. 6.

The number of cameras or light fixtures is not limited to those shown in FIG. 6; that is, it could be only one, three or even more, depending on e.g. the width of the wire 63 and the pulp on it. The cameras 61, 62*a*, 61*b*, 64*a*, 64*b* and the light fixtures 66, 67 are connected, either in a wired or a wireless manner, to a computing device (not shown), as in FIG. 2, or the cameras are so-called Smart cameras, as in FIG. 1, whereby the light fixtures 66, 67 may be connected to the cameras, either in a wired or a wireless manner. Foils 68 are provided under the wire 63 for adjusting the activity of the pulp. Further, on the basis of the comparisons made by the computing device it is possible to determine the required adjustments in the supply of pulp from the head box 65 and/or in the foils 68, for changing/adjusting the activity, as well as for changing and/or adjusting the adjustments/settings/functions of the cameras 61, 62*a*, 61*b*, 64*a*, 64*b* and/or the light fixtures 66, 67, so that the monitoring system 60 can capture the activity of the pulp in a more accurate and/or versatile way. The direction of running of the wire 63 is away from the head box 65, as shown by the arrow in FIG. 6. The running direction of the wire is always the same as the running direction of the pulp. FIG. 7 shows the monitoring system 60 of FIG. 6 in a top view.

Figure 8:
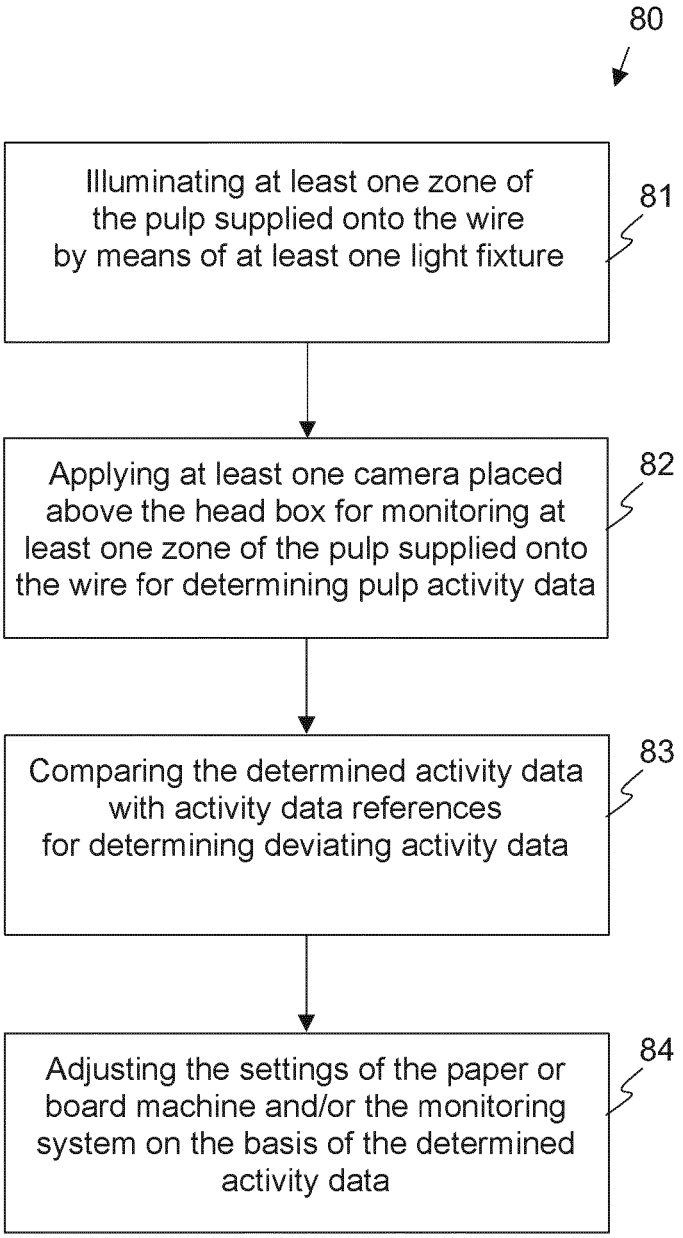
FIG. 8 illustrates the monitoring method according to an advantageous embodiment of the disclosed embodiments, in a flow chart.

FIG. 8 shows a flow chart 80 of the system according to an advantageous embodiment of the present disclosure, for monitoring the wet end of a paper machine. In a first step 81, at least one zone of the pulp supplied onto the wire is illuminated by at least one light fixture. The light fixture may be by the side of the wire, above the wire, above the head box, above the edge of the head box, or above the wire in front of the head box. In a second step 82, at least one camera placed above the head box is used for monitoring at least one said zone of the pulp supplied onto the wire, for determining data on the activity of the pulp. However, it is possible that at least one camera for monitoring the activity is placed by the side of the wire, above the wire, above the edge of the head box, above the wire in front of the head box, instead of placing above the head box, or that in case of at least two or more cameras, at least one of the cameras is placed in a different location from at least one other camera, for monitoring the pulp. In a third step, the determined activity data is compared with activity data references, for determining deviating activity data by a computing device which may be a part of the camera or a separate device. In a fourth step 84, the settings of the paper or board machine and/or the monitoring system are adjusted on the basis of the activity data. The settings of the paper or board machine, and/or the monitoring system, may be adjusted on the basis of the activity data, for example, when the activity data was found in step 83 to be deviating.

In the method, the settings of the head box can be adjusted on the basis of the activity data. By adjusting the settings of the head box, it is possible to change the settings of the head box itself as well as its supply piping and thereby to influence the properties of the pulp. By adjusting the flow rate, orientation and turbulence settings of the pulp jet, it is possible to influence the square mass distribution and fibre orientation. Similarly, the settings of the foils can be adjusted in the method to make the pulp homogeneous in terms of consistency and distribution of fine particles. Furthermore, the settings of at least one camera and light fixture can be controlled on the basis of the activity data determined in the method.

It is thus possible that the monitoring system according to the disclosed embodiments comprises merely activity capturing cameras, i.e. activity cameras, placed above the head box, or that the monitoring system according to the disclosed embodiments comprises, in addition to activity cameras placed above the head box, low-level activity cameras on either one or both sides of the wire (and the pulp), or that the monitoring system according to the disclosed embodiments comprises, in addition to activity cameras placed above the head box, high-level activity cameras placed on either one or both sides of the wire (and the pulp), or that the monitoring system according to the disclosed embodiments comprises, in addition to activity cameras placed above the head box, both low-level and high-level activity cameras on either one or both sides of the wire (and the pulp).

The cameras and the light fixtures can be fastened to various frameworks or supports made of e.g. metal and placed above the head box. Alternatively, it is also possible to mount the cameras and the light fixtures directly on top of the head box, or to provide a camera beam above the head box, to receive the cameras and the light fixtures. Similarly, various frameworks, supports or arms made of e.g. metal, may be provided for cameras or light fixtures to be placed by the sides of the wire. The frameworks, supports, arms, or beams may be used, for example, to secure the correct field of view and location of the camera in relation to the wire, as well as the correct angle of illumination and location of the light fixture in relation to the wire. The cameras used in the system for monitoring the wet end may be so-called pinhole cameras, or the cameras may comprise so-called pinhole lenses, because the soiling degree of the camera lens area is relatively high at the wet end.

The field of view of the activity cameras with respect to the wire can be selected relatively freely according to the activity to be measured or the target, but in general, the activity cameras capture at an angle smaller than 90°, and cameras above the head box and low-level cameras capture at an angle smaller than 45° to the wire.

It will be obvious that the present disclosure is not limited solely to the above-presented embodiments, but it can be modified within the scope of the appended claims.

The invention claimed is:

1. A monitoring system for the wet end of a paper or board machine, wherein the system comprises:

at least one light fixture for illuminating pulp supplied onto a wire, at least one image sensor to be placed above the head box at the wet end of the machine, for capturing the activity of the pulp supplied from the head box in the wire section, in the direction of the movement of the wire; wherein the system further comprises;

a computing device, to which at least one image sensor is configured to transmit image information for determining activity data on the pulp, the computing device being configured to adjust the settings of the paper or board machine and at least one image sensor of the monitoring system so that an angle of the image sensor with respect to the wire changes or so that a pass band of a filter of the image sensor changes, on the basis of the determined activity data.

2. The monitoring system according to claim 1, wherein the image sensor captures the activity of the pulp at an angle not greater than 45° to the surface of the wire.

3. The monitoring system according to claim 1, wherein the activity is amplitude, scale, duration of activity, or a combination of these in a predetermined zone.

4. The monitoring system according to claim 1, wherein the computing device is an integrated part of the image sensor, or wherein the computing device is connected to the image sensor in a wired or wireless manner for receiving image information.

5. The monitoring system according to claim 1, wherein the determined activity data is used for adjusting the settings of the head box and the foils in the paper or board machine.

6. The monitoring system according to claim 1, wherein the determined activity data is used for adjusting the settings of at least one light fixture in the monitoring system.

7. A method for monitoring the wet end of a paper or board machine, the method comprising:

illuminating at least one section of pulp supplied onto the wire, by at least one light fixture, monitoring said at least one section of the pulp supplied onto the wire, by at least one camera placed above the head box, for determining activity data of the pulp, comparing the determined activity data with activity data references, for determining deviating activity data, wherein the method further comprises:

adjusting the settings of the paper or board machine and at least one image sensor of the monitoring system so that an angle of the image sensor with respect to the wire changes or so that a pass band of a filter of the image sensor changes, on the basis of the determined activity data.

8. The method according to claim 7, comprising adjusting the settings of the head box on the basis of the determined activity data.

9. The method according to claim 7, comprising adjusting the settings of the foils of the paper or board machine on the basis of the determined activity data.

10. The method according to claim 7 comprising adjusting the settings of at least one light fixture in the monitoring system on the basis of the determined activity data.

11. The method according to 7, the method comprising illuminating and monitoring the pulp supplied onto the wire in at least two sections on the wire, and determining the activity data of these at least two sections compared with activity references, and adjusting the settings of the paper or board machine and/or of the monitoring system on the basis of the determined activity data.

* * * * *